United States Patent [19]

Fiocchi

[11] Patent Number: 4,574,701

[45] Date of Patent: Mar. 11, 1986

[54] WAD FOR CARTRIDGES OF HUNTING AND SHOOTING ARMS

[75] Inventor: Pino Fiocchi, Lecco, Italy

[73] Assignee: Fiocchi Munizioni Spa, Italy

[21] Appl. No.: 540,506

[22] Filed: Oct. 11, 1983

[30] Foreign Application Priority Data

Oct. 12, 1982 [IT] Italy ..... 23152/82[U]

[51] Int. Cl.[4] ..... F42B 7/08

[52] U.S. Cl. ..... 102/451; 102/532

[58] Field of Search ..... 102/448–463, 102/532

[56] References Cited

U.S. PATENT DOCUMENTS

| | | | |
|---|---|---|---|
| 997,566 | 7/1911 | Leach | 102/461 |
| 3,368,489 | 2/1968 | Herter | 102/451 |
| 3,623,431 | 11/1971 | Hendricks | 102/452 |
| 3,722,420 | 3/1973 | Herter | 102/451 |
| 3,812,784 | 5/1974 | Herter | 102/451 |
| 3,835,783 | 9/1974 | Curran | 102/451 |
| 4,220,090 | 9/1980 | Fackler | 102/532 |

FOREIGN PATENT DOCUMENTS

| | | | |
|---|---|---|---|
| 1548296 | 12/1968 | France | 102/449 |

*Primary Examiner*—Harold J. Tudor

*Attorney, Agent, or Firm*—Kalish & Gilster

[57] ABSTRACT

An improved wad and shot cup structure for shotgun shells or so-called shot shell cartridges for hunting and shooting use, including a substantially cylindrical body of plastic material forming a shot cup or bowl (7) containing lead shot (11) and a powder seal cup (17) for confining the firing charge, the shot cup and powder seal cup being connected by a cushioning structure (6). The latter includes disc-shaped elements or so-called tiles (9) of diameter such that, if flattened as caused by the thrust of the firing charge, it is substantially greater than the inner diameter of the gun barrel. The tiles are connected and separated by walls (10) by which the force is ultimately transferred from the powder seal cup to the shot cup, the tiles providing sealing against leakage of explosion gases and contributing to the cushioning effect of the cushioning structure, which constitutes a wad.

5 Claims, 6 Drawing Figures

WAD FOR CARTRIDGES OF HUNTING AND SHOOTING ARMS

BACKGROUND AND SUMMARY OF THE INVENTION

The present invention relates to an improved wad for shotgun shell or so-called shot shell cartridges for hunting and shooting arms, and more particularly, to an improved cushioning and sealing structure of such wad.

Known shotgun cartridges for hunting use include a case or tubular envelope, usually of plastic material, closed at its lower end with a metal base and, at its upper end, by what is known as a star crimp. Inside the tubular, cylindrical envelope is a so-called wad of plastic material, usually extending along about the whole length of the cartridge. Such wad consists of a cushioning base or lower end providing a seat which covers the powder charge and, at its upper end, a bowl or cup for lead shot.

More particularly, several functions are fulfilled by wads of the above-mentioned type. In summary, these functions include carrying out a sealing action with respect to the shotgun barrel, containing the mass of the lead shot and protecting against frictional movement of the shot along the barrel, and also protecting against infiltration through the shot of the hot gases of burning powder, as well as damping or reducing the recoil effect upon firing of the gun.

Known wads, as heretofore used, generally include also a cushioning structure, which, in essence, comprises a substantially tubular element positioned between the shot cup or bowl and the seat covering the powder charge. The tubular element may have circular section, and is lozenged, multi-lozenged, or may include superimposed multitubular elements or the like which, because of flattening upon shooting, give rise to the cushioning effect.

In the embodiment disclosed in German Patent Specification No. 2 708 352, there is disclosed a wad system providing a cushioning structure comprising substantially flat, parallel portions lying at planes which are spaced from each other and perpendicular with respect to the cartridge axis. The aforementioned flat portions, being preferably disk-shaped, are spaced from each other and joined by connecting staggered walls which act as struts or stiff rods between the flat portions. Upon shooting, the explosive thrust against such wad causes the above-mentioned structure to be flattened, the flat portions being deformed according to a substantially sinusoidal configuration which is caused by said struts. Cartridges of this type present some drawbacks, particularly with respect to sealing conditions in that leakage of the propelling gas takes place between the wad and the internal wall of the shotgun barrel.

Such a sealing problem exists for conventional wads at the cartridge-case mouth at which location the main sealing element of the wad, namely the powder cup, must abruptly change its section when moving across the cartridge envelope rim in order to continue maintaining a sealing action against the barrel wall. Although carried out as rapidly as possible, such a change in section actually permits leakage, even if limited, of the propellant gases, to the detriment of full exploitation of the power of the propelling charge. This condition may be confirmed or evidenced by the fact that the upstream portion of a conventional wad, i.e., such portion of the wad as is located above the powder cup, shows an evident blackening due to such leakage of gases.

It should also be pointed out that the cushioning effect of known wads, e.g., as described in the above-mentioned German disclosure, does not provide any sealing action to prevent such gas leakage. Another problem arising from a conventional cartridge of this character is that there is not always a correct direction of the lead shot column.

An object of the present invention is the provision of a wad for shotgun cartridges for hunting and shooting arms which overcomes the above-noted limitations and drawbacks of the prior art, particularly, in that the present invention provides an improved type of wad that overcomes the problem of increasing the gas seal under compression for improving both the range and the accuracy of firing without increase of the friction with the shotgun barrel as would be detrimental to weapon effectiveness.

These and other objects are provided by the new wad for shotgun cartridges for hunting and shooting arms in accordance with the invention, as comprising a substantially cylindrical body of plastic material including a shot cup or bowl and a powder cup for confining the explosive and firing charge, the firing cup and shot cup being connected by a cushioning structure which provides additional sealing elements upstream of the firing cup, i.e., with respect to the advancement direction of the wad within the barrel, for avoiding explosion gas leakage.

According to further features of the invention, the cushioning structure comprises at least one additional sealing element wherein the latter is formed of a disk-shaped so-called tile of concave nature, the concavity of which is turned toward the powder cup and having a diameter such that when the tile is flattened upon firing, the diameter would be slightly greater than the inner diameter of the shotgun barrel. One side of the tile is connected to the shot cup or bowl, the other side being connected to the powder cup, and wherein the cushioning structure further comprises an axially connected rod between such tile and the powder cup.

According to a preferred embodiment of the present invention, the cushioning structure of the wad comprises at least two such tiles, each consisting of a disk-shaped element which is bent in tile-like character along one diameter, which diameter consequently represents the top edge of the tile, and wherein the tiles are reciprocally connected by walls which are outwardly inclined with respect to the cartridge base, the walls being preferably substantially perpendicularly positioned with respect to the inclined side portions of each such tile.

According to a further improvement of a wad of the invention, the powder cup is of semispheric shape, rather than having a flat bottom, and thus providing greater sealing action and a more uniform distribution of the forces on such powder cup, which thus act accordingly upon the wad during firing.

According to another characteristic of the present invention, the shot cup or bowl has a plurality of full thickness flutes directed along the generating lines of the shot cup, and including also vertical ribs which are spaced adequately apart and directed along the same generating lines.

In accordance with the further aspect of the wad of the invention, the diameter of the shot cup or bowl is less than that of the powder cup, and also of the tiles and such vertical ribs, reducing friction during movement of the wad along the shotgun barrel.

These and other characteristics wil be apparent from the following description describing a preferred embodiment of a wad in accordance with the invention, as illustrated by way of example and not of limitation in the drawing figures.

DESCRIPTION OF THE PREFERRED EMBODIMENT

Figure 1:
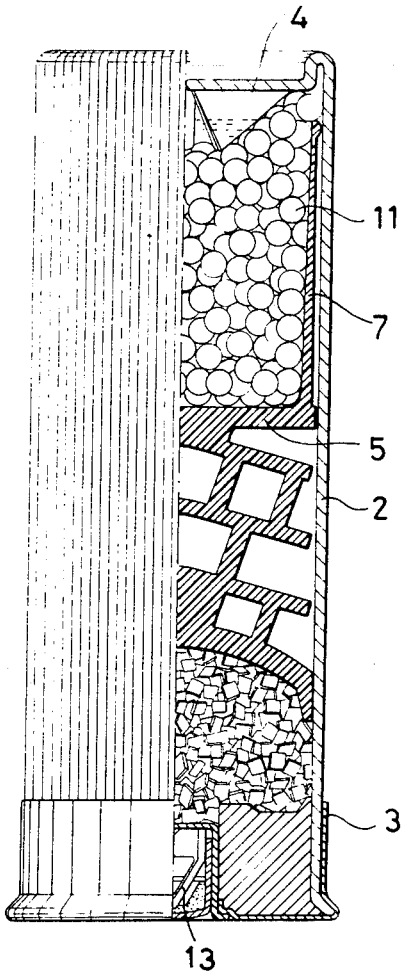
FIG. 1 is a side elevation view, partially in longitudinal cross-section, of a shotgun cartridge including a wad in accordance with invention.

As shown in FIG. 1, the new shotgun cartridge for shooting and hunting comprises a plastic envelope 2 closed at its lower and upper ends, respectively, with a metal base 3 containing a primer 13 which performs as a primary charge, and an appropriate closure 4 such as a so-called star crimp.

Figure 2:
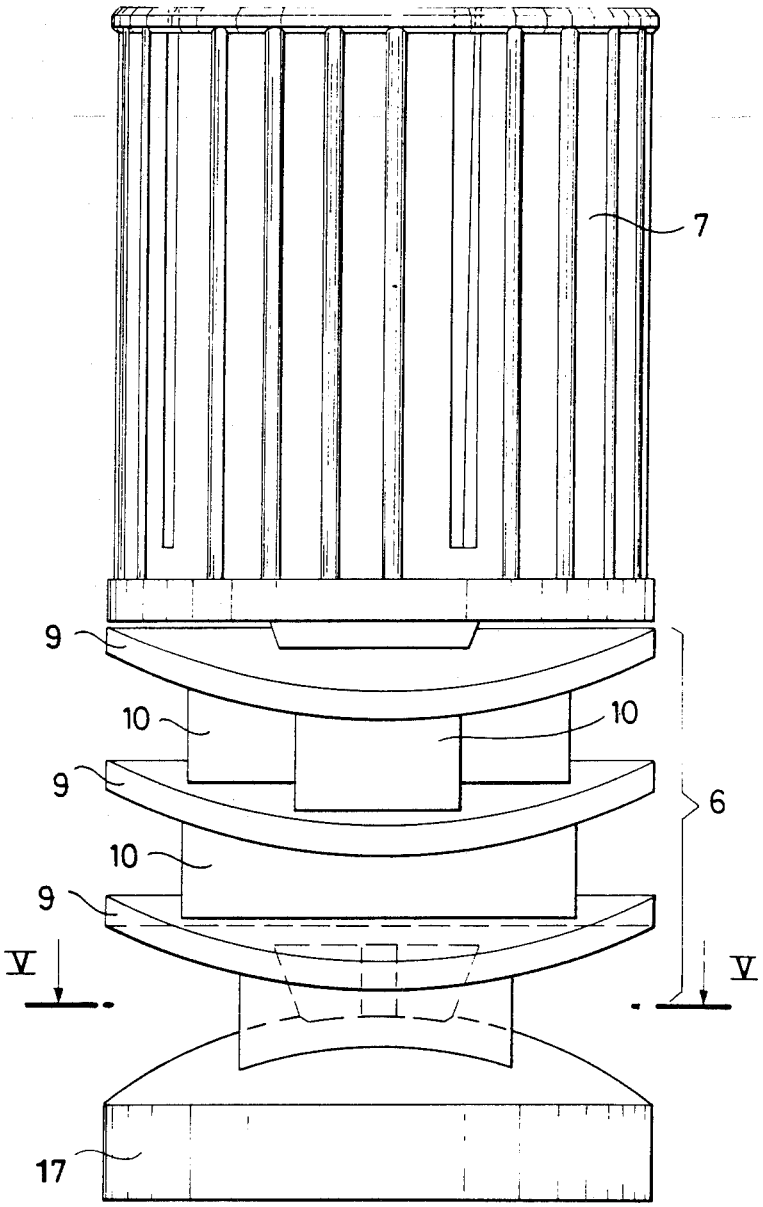
FIG. 2 is a side elevation view of the wad in the cartridge of FIG. 1.
Figure 4:
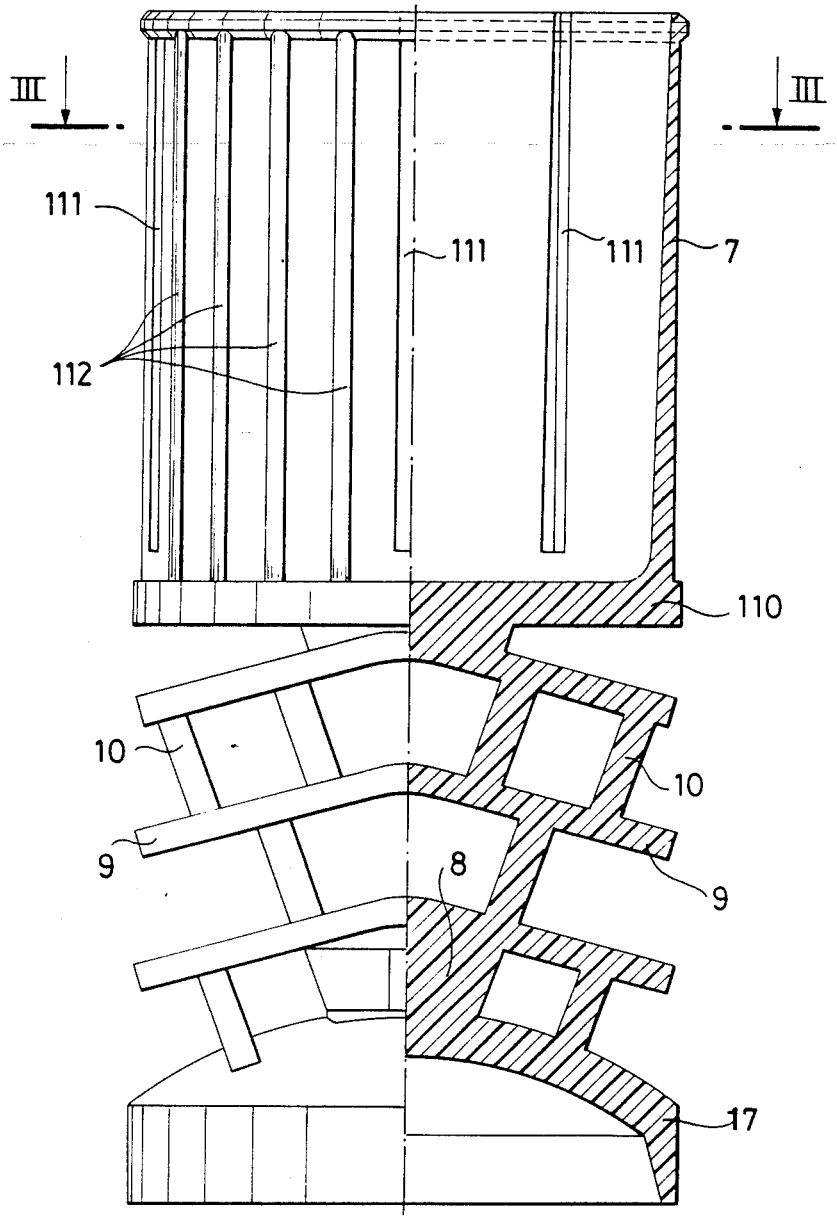
FIG. 4 is a side view, partially in longitudinal section, of a wad of the invention.

Inside the cylindrical body or enclosure 2 is a wad 5, the same being adherently contained within envelope 2, and comprising a body molded of plastic material to provide a cushioning lower base 6 (see FIG. 2) and a shot cup or bowl 7 installed on such base. Said base 6 includes a small inverted powder cup 17 (FIG. 2) having a substantially semispheric shape in cross-section, as revealed in FIG. 4, which contains and covers the cartridge powder charge, as clearly evident in FIG. 1.

Figure 5:
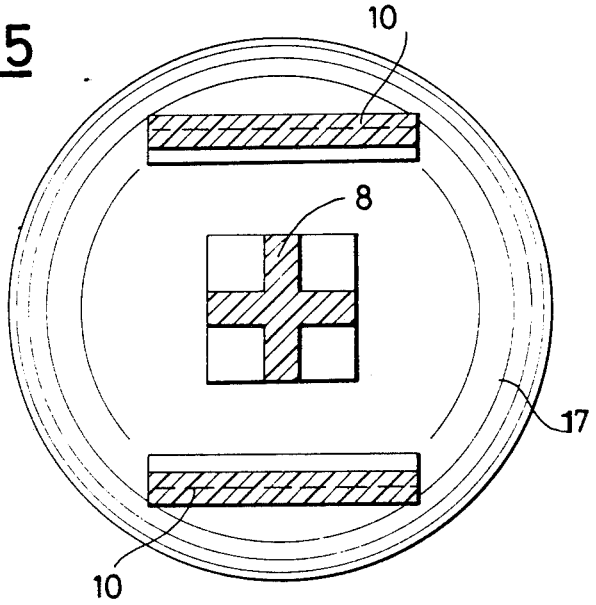
FIG. 5 is a similar cross-sectional view of V—V of FIG. 1.

Extending upward from the powder cup 17 from its upper portion or tip is a cushioning unit comprising a central rod or stem 8 which is of "x" or cross-shaped section (see FIG. 5), a plurality of contiguous so-called tiles 9 of disk-shaped configuration which are coaxial with rod 8 and are curved downwardly, being directed thus in a curving manner toward the bottom of the cartridge in the same way as outer cup 17, and also walls 10 which connect the contiguous tiles 9. Although not illustrated, said tiles 9 may also include reinforcing ribs for performing a stiffening function. Tiles 9 are preferably obtained from disks bent along one diameter which is slightly greater, for reasons set forth below, than the inner diameter of the shotgun barrel 1 (see FIG. 6).

Figure 3:
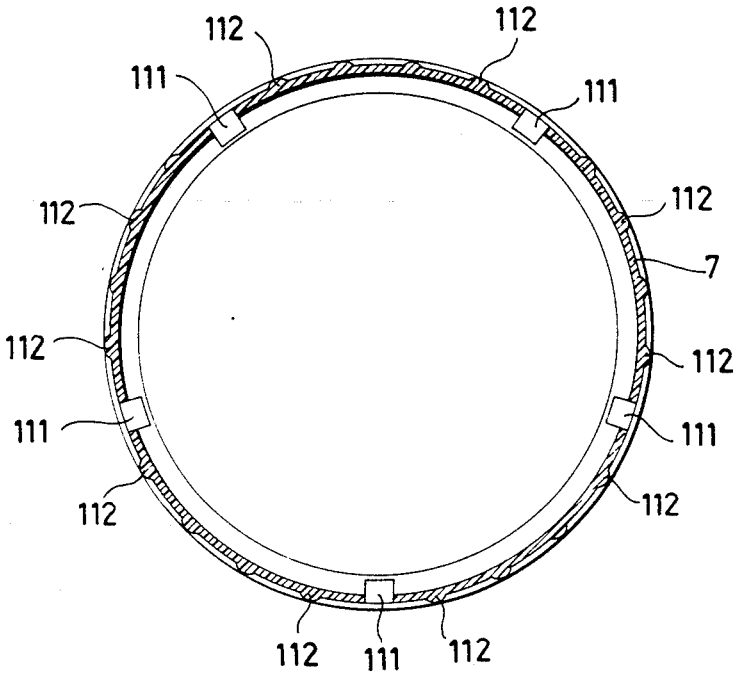
FIG. 3 is a lateral cross-section as taken along line III—III of FIG. 2.

Shot cup or bowl 7, as clearly intended for containing the lead shot 11, is shown to include a base 110 (FIG. 4), and including also a plurality of longitudinal flutes 111 and a series of vertical ribs 112 which are directed along the generating lines of cup 7 and protrude outside its surface. As apparent from the drawings, and particularly as illustrated in FIG. 3, shot cup 7 is of lesser diameter than the powder cup 17 which provides a gas seal action which, by virtue of the semispheric shape of such cup, partly provides improved sealing against leakage of combustion gas. The gas seal action of the wad provided by cup 17 increases its adherence either with the cartridge walls, while it is in the cartridge, or to the shotgun barrel. This results from the compression caused by rod 8 which, during combustion, provides for deflection and widening of cup 17.

The disk-shaped tiles 9 provide not only cushioning of the shot cup 7, but also constitute a barrier against possible residual gas leaks. Accordingly, during combustion, the resultant compression delivered to the cushioning structure 6 operates on tiles 9 through walls 10 by widening tiles 9 into a substantially flat configuration and thus increasing their transverse dimension and, accordingly, enhancing the function fulfilled by the powder cup 17. Without intending to limit the scope of the invention, it is important to point out that, in response to the force produced by combustion of the main charge, walls 10 act as elements hinged at their end portions, i.e., at the point of the connection of each wall 10 to the corresponding tiles 9 to the powder cup 17.

Walls 10 are so inclined that their upper and outermost edges turn relatively away from the axis of the cartridge, causing the tiles 9 to be displaced and to spread out by raising of their outer edges with respect to the tile top edge, thus carrying out a sealing action against either the adjacent cartridge envelope wall or the gun barrel.

Walls 10 have thickness sufficient for exhibiting the strength necessary for deformation of tiles 9, while allowing walls 10 also to be deformed. Thus, walls 10 aid the cushioning function of tiles 9.

Figure 6:
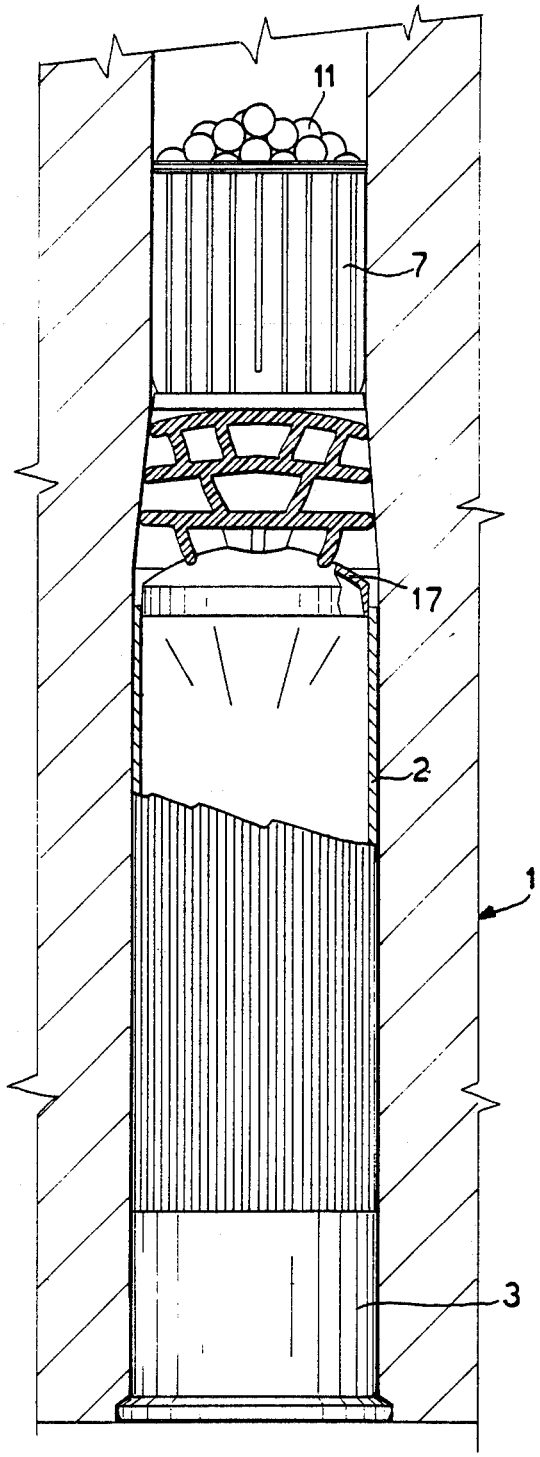
FIG. 6 is a longitudinal cross-section of a weapon, including a cartridge of the present type as illustrating the movement of a wad of the invention from the cartridge into the barrel of the weapon during firing.

With reference to FIG. 6, the unusual and highly advantageous features of a wad of the invention are observed. During shooting of the cartridge, i.e., when percussion of the priming charge causes combustion of the main charge, the wad is projected outwardly from the cartridge envelope 2, which remains within the cartridge chamber until it is later ejected. Thus, as illustrated in FIG. 6, a moment exists at which the base or powder cup 17, although still contained within envelope 2, nears its upper free edge. At this point, as specifically shown, cup 17 is in readiness to pass beyond the upper edge of envelope 2 and then to further expand for providing sealing action against the barrel walls. At this moment, conventional wads exhibit leakage or loss of the combustion gases between the base cup and the outer edge of the envelope and adjacent barrel walls, even though such leakage is in limited degree through recourse to various expedients. Such leakage is proved by the fact that wads, when recovered after shooting, more or less show traces (blackening) of gas leakage at the bottom portion of the shot cup, abeam the base cup. Accordingly, the combustion power is partly wasted by such conventional wads. A wad of the present invention fully and satisfactorily solves this problem since, prior to the aforesaid moment at which the base or powder cup is prepared to leave the cartridge shell or envelope 2, the diskshaped tiles 9 have already emerged from the envelope and have expanded to permit sufficient sealing action against the gun barrel, as depicted in FIG. 6.

The provision of preferably five flutes 111 on the cylindrical wall of the shot cup 7 decrease possible negative influences on the directionality of the lead shot column when the assembly of wad and lead shot has left the weapon barrel and the wad has separated from the lead shot, while the lateral walls 10 contribute to the overall cushioning effect provided by wad portion 6.

Although the present invention has been described with reference to a specific embodiment, it will be understood that the invention is susceptible of changes and modifications falling within the scope of the present invention. For example, modified tiles are foreseeable wherein advantage is taken of additional sealing action only upstream of the base or powder cup 17, and with the cushioning function being fulfilled by separate components of conventional type, for example.

I claim:

1. For use in a shotgun cartridge of the type for use in a shotgun for hunting or shooting, the cartridge having a substantially cylindrical envelope, an improved wad including a shot cup and a base cup for confining a propellant charge, characterized by the base cup being configured for expanding against the interior surfaces of the envelope and against inner surfaces of a barrel of the shotgun, a cushioning structure interposed between the shot cup and base cup, the cushioning structure comprising a vertical stack of disk-shaped tiles each of concave nature for providing a concavity opening toward the base cup, each such tile being of tile configuration formed by bending along one diameter, such diameter representing the top edge of the respective tile, the tiles being interconnected by walls outwardly inclined relative to the cartridge base and the tiles taking a substantially flattened configuration upon combustion of the propellant charge and for providing a diameter when flattened which is slightly greater than the inner diameter of the barrel, an axial rod interconnecting the base cup and a lower side of a bottom one of said stack of tiles, and means interconnecting an upper side of an upper one of said stack of tiles and the shot cup whereby upon firing, the tiles provide sealing action against inner surfaces of the barrel before emergence of the base cup from the envelope to prevent leakage of combustion gases.

2. A wad according to claim 1 and further characterized by the axial rod being substantially of "x"-shaped section.

3. A wad according to claim 1 and further characterized by the base cup being semi-spherically shaped.

4. A wad according to claim 1 and further characterized by the shot cup being provided with a plurality of full thickness flutes directed along the lines of generation of the shot cup, including a plurality of vertical ribs projecting outwardly from the external surface of the shot cup.

5. A wad according to claim 4 and further characterized by the diameter of the shot cup being less than that of the base cup for reducing friction with respect to the barrel upon firing.

* * * * *